US007646998B2

(12) United States Patent
Ota

(10) Patent No.: US 7,646,998 B2
(45) Date of Patent: Jan. 12, 2010

(54) IMAGE FORMING APPARATUS, FIXING DEVICE AND FIXING DEVICE CONTROL METHOD

(75) Inventor: Hiroshi Ota, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 215 days.

(21) Appl. No.: 11/775,353

(22) Filed: Jul. 10, 2007

(65) Prior Publication Data

US 2008/0019722 A1 Jan. 24, 2008

(30) Foreign Application Priority Data

Jul. 21, 2006 (JP) ..... 2006-200126

(51) Int. Cl.
*G03G 15/20* (2006.01)

(52) U.S. Cl. ..... 399/69; 399/67; 399/70

(58) Field of Classification Search ..... 399/69, 399/70, 67

See application file for complete search history.

(56) References Cited

U.S. PATENT DOCUMENTS 5,701,555 A * 12/1997 Masuda et al. ..... 399/69
2006/0127119 A1* 6/2006 Sato ..... 399/69
2006/0127143 A1* 6/2006 Tamura et al. ..... 399/329
2006/0134543 A1* 6/2006 Kashiwabara et al. .... 430/109.3
2006/0138126 A1* 6/2006 Watanabe ..... 219/619

FOREIGN PATENT DOCUMENTS

JP 2003-330312 11/2003

* cited by examiner

*Primary Examiner*—David M Gray
*Assistant Examiner*—Rodney Bonnette
(74) *Attorney, Agent, or Firm*—Turocy & Watson, LLP

(57) ABSTRACT

An image forming apparatus includes an image forming unit to form a developer image on a medium, a heating body to heat the developer image formed on the medium, a heat source provided in the heating body to heat the heating body, and a pressing body arranged opposite to the heating body to permit the medium to pass between the pressing body and the heating body, thereby pressurizing the developer image. The image forming apparatus further includes a controller to drive the heat source, even if the heating body is heated from the room temperature state, and the temperature of the heating body rises higher than the fixing temperature, and then the temperature of the heating body is higher than the fixing temperature.

21 Claims, 6 Drawing Sheets

IMAGE FORMING APPARATUS, FIXING DEVICE AND FIXING DEVICE CONTROL METHOD

CROSS-REFERENCE TO RELATED APPLICATION

This application is based upon and claims the benefit of priority from the prior Japanese Patent Application No. 2006-200126 filed on Jul. 21, 2006, the entire contents of which are incorporated herein by reference.

BACKGROUND

1. Field of the Invention

The present invention relates to an image forming apparatus and a fixing device and more particularly to an image forming apparatus, a fixing device, and a fixing device control method in which the temperature control method for the fixing device is improved.

2. Description of the Related Art

Conventionally, as disclosed in Japanese Patent Application Publication No. 2003-330312, there is an image forming apparatus in consideration of shortening the time required for a heat roller to reach the fixing temperature when the switch thereof is turned on. The fixing temperature means the temperature of the heat roller at the time of the toner on a recording sheet being fixed.

A heater lamp of such a fixing device, after the heat roller reaches the fixing temperature, until the overshooting heat roller returns to the set temperature, may be kept in the heater lamp off state for a certain period of time. When taking a copy in the state that the heater lamp is off for some time after warming up, the heat roller loses heat to the pressing roller and a recording sheet simultaneously with rotation of the fixing device, and the temperature of the heat roller falls suddenly, and defective fixing may be caused.

SUMMARY

An object of the present invention is to provide an image forming apparatus, a fixing device, and a fixing device control method by which when the heat roller is heated from the room temperature state, exceeds the fixing temperature, and is overshot, and then the temperature falls, the heater lamp inside the heat roller is lit forcibly, thus the heat roller is prevented from sudden reduction in temperature when printing is requested, and defective printing can be prevented.

According to the embodiment of the present invention, there is provided an image forming apparatus composing an image forming unit to form a developer image on a medium; a heating body to heat the developer image formed on the medium; a heat source provided in the heating body to heat the heating body; a pressing body arranged opposite to the heating body to permitting the medium to pass between the pressing body and the heating body, thereby pressurizing the developer image; and a controller to drive the heat source, even if the heating body is heated from the room temperature state, and the temperature of the heating body rises higher than the fixing temperature, and then the temperature of the heating body is higher than the fixing temperature.

Furthermore, according to the embodiment of the present invention, there is provided a fixing device composing a heating body to heat a developer image formed on a medium; a heat source provided in the heating body to heat the heating body; a pressing body arranged opposite to the heating body to permit the medium to pass between the pressing body and the heating body, thereby pressurizing the developer image; and a controller to drive the heat source, even if the heating body is heated from the room temperature state, and the temperature of the heating body rises higher than the fixing temperature, and then the temperature of the heating body is higher than the fixing temperature.

Furthermore, according to the embodiment of the present invention, there is provided a fixing temperature control method for a fixing device comprising a heating body and a pressing boy arranged opposite to the heating body, comprising heating the heating body by a heat source from a room temperature state; and turning on or off the heat source even if the temperature of the heating body rises higher than the fixing temperature and then the temperature of the heating body is higher than the fixing temperature.

DETAILED DESCRIPTION OF THE EMBODIMENTS

Hereinafter, the embodiment of the present invention will be explained with reference to the accompanying drawings. However, the dimensions, materials, and shapes of the components described in this embodiment, unless otherwise specified, do not restrict the scope of the present invention.

Figure 1:
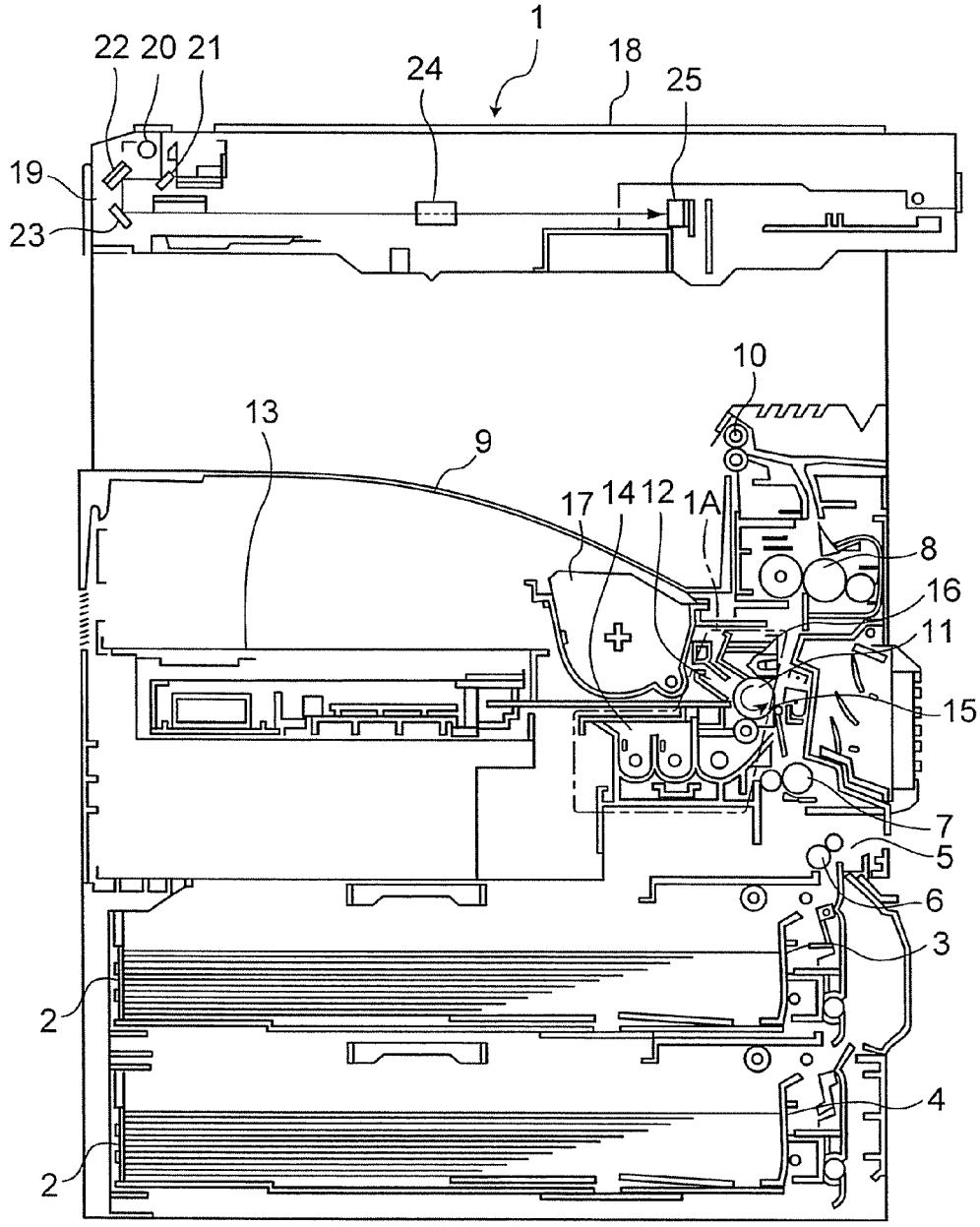
FIG. 1 is a schematic cross sectional view showing the inside of the image forming apparatus which is an embodiment of the present invention.

FIG. 1 is an internal schematic view showing the main body of the image forming apparatus which is an embodiment of the present invention. Under a main body 1, a plurality of sheet supply cassettes 3 and 4 storing recording media 2 as media, for example, recording sheets are installed. The recording media 2 are conveyed upward via a sheet conveying path 5. On the sheet conveying path 5, conveying rollers 6 for conveying the recording media 2 up to a process cartridge 1A, aligning rollers 7, a fixing device 8, and exit rollers 10 for ejecting the recording media 2 finishing image recording to a sheet receiving tray 9 are arranged.

At the central part in the main body 1, the process cartridge 1A which is an image forming unit is removably installed on the main body. The process cartridge 1A has a photosensitive drum 11 attached rotatably. Around the photosensitive drum 11, in the direction of the arrow (counterclockwise), a corona discharge type main charger 12, an exposure device 13, a developing device 14, a transfer device 15, and a cleaning device 16 are arranged. Above the developing device 14, a toner supply device 17 is installed.

In the upper area of the main body 1, a document table 18 is installed. Under the document table 18, a scanner 19 for reading a document on the document table 18 is installed. The scanner 19 includes a light source 20 for irradiating light to the document, a first reflection mirror 21 for reflecting light reflected from the document in a predetermined direction, second and third reflection mirrors 22 and 23 for sequentially reflecting light reflected from the first reflection mirror 21, a condenser lens 24 for focusing reflected light from the third reflection mirror 23 on the image forming face of a light receiving element 25, and the light receiving element 25 for receiving the light focused by the condenser lens 24.

The operation of each unit at time of image formation will be explained. Firstly, when reading a document put on the document table 18, light is irradiated to the document from the light source 20. The light is reflected from the document and is received by the light receiving element 25 via the first reflection mirror 21, second reflection mirror 22, and third reflection mirror 23, thus the document image is read. Here, the first reflection mirror 21, by a drive means not drawn, moves from under the light source 20 shown in FIG. 1 in the longitudinal direction of the document and reads the document. At this time, to keep the optical path length which is a distance between the document and the image forming face of the light receiving element 25 unchanged, the second reflection mirror 22 and third reflection mirror 23 move simultaneously.

On the basis of this reading information, a laser beam is irradiated from the exposure device 13 to the photosensitive drum 11. The surface of the photosensitive drum 11 is charged uniformly by the main charger 12, and the laser beam with its intensity modulated according to the image information is irradiated from the exposure device 13, thus an electrostatic latent image corresponding to the image to be copied is formed on the photosensitive drum 11. The electrostatic latent image formed on the photosensitive drum 11 is adhered with toner charged in reverse polarity to the electrostatic latent image by the developing device 14 and is changed to a visible image.

And, the toner adhered to the electrostatic latent image is conveyed from under the process cartridge 1A and is superimposed on the recording medium 2 aligned by the aligning rollers 7, and from the rear of the recording medium 2, by the transfer device 15, a charge in reverse polarity to the charging polarity of the toner is given to the recording medium 2, thus the toner is transferred to the recording medium 2 by electrostatic force. The recording medium 2 to which the toner is transferred is conveyed to the fixing device 8 and is applied with heat or pressure by the fixing device 8, thus the toner is fixed on the recording medium 2. The recording medium 2 finishing image formation is ejected onto the sheet receiving tray 9 via the exit rollers 10. On the other hand, residual toner remaining on the photosensitive drum 11 without transferred is removed by the cleaning device 16.

Figure 2:
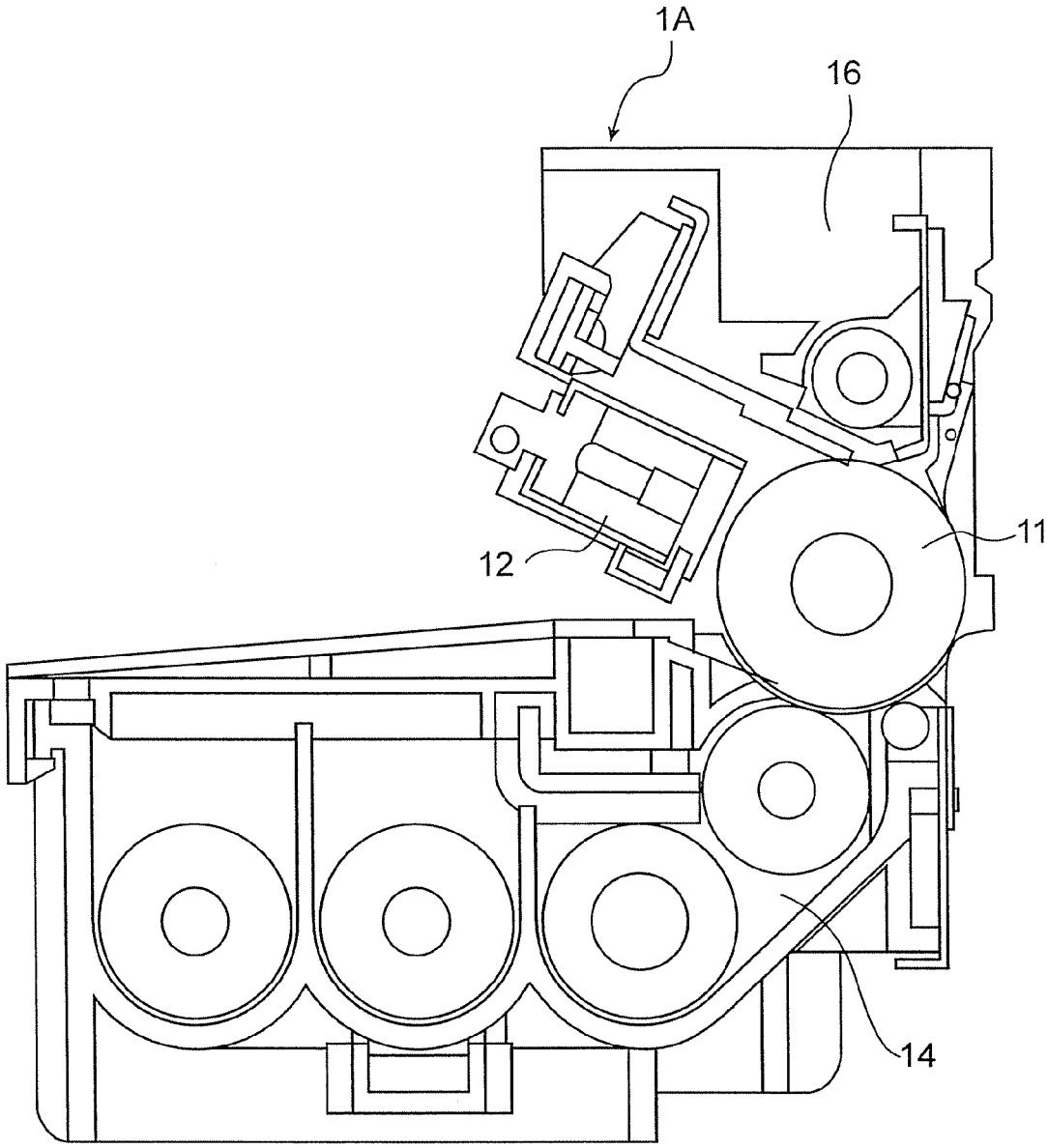
FIG. 2 is a cross sectional view showing the process cartridge.

Next, the main charger 12 in the process cartridge 1A will be explained. FIG. 2 is a cross sectional view of the process cartridge 1A. The process cartridge 1A is composed of the photosensitive drum 11, main charger 12, developing device 14, and cleaning device 16. Further, the process cartridge can be removed from the main body 1.

Figure 3:
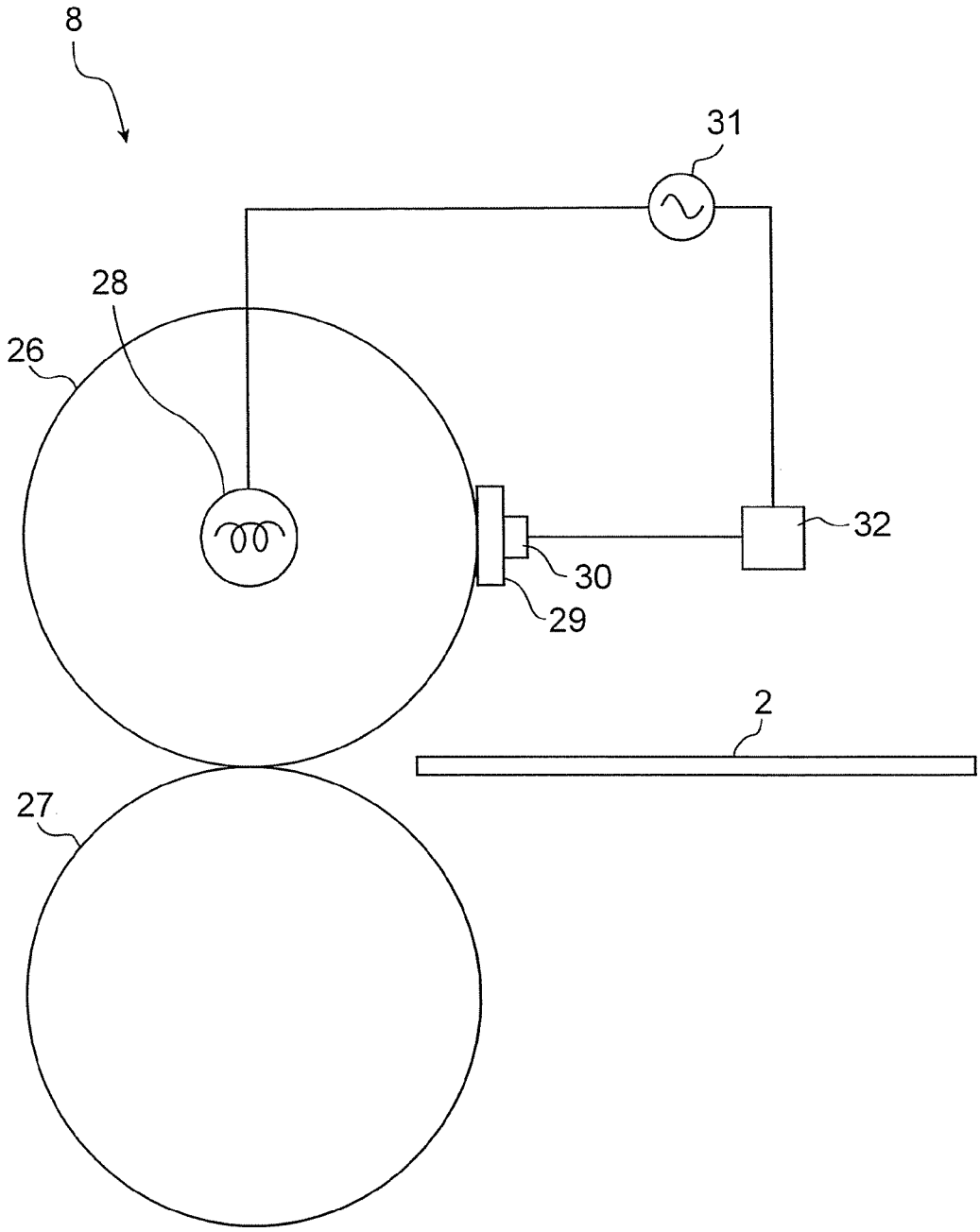
FIG. 3 is a schematic cross sectional view showing the fixing device which is an embodiment of the present invention.

Next, the fixing device 8 of this embodiment will be explained by referring to FIG. 3. FIG. 3 is a schematic view showing the constitution of the fixing device 8 of this embodiment. The fixing device 8 is equipped with a heat roller 26 which is a heating body. In the heat roller 26, a heater lamp 28 (for example, 900 W) which is a heat source is installed. Further, opposite to the heat roller 26, a pressing roller 27 which is a pressing body for pressing from under the heat roller 26 is installed.

The heat roller 26 of this embodiment uses a core bar made of a hollow metal such as aluminum or iron, which is coated with fluorine plastics to form a film layer. Further, to make the start-up of the apparatus satisfactory, it is desirable to use a thin core bar having a low heat capacity. In this embodiment, the diameter of the heat roller 26 is, for example, 30 mm and the thickness of the core bar is 1 mm.

Further, the pressing roller 27 uses a one that for example, rubber with a thickness of 1 mm is coated on an aluminum core bar with a diameter of 20 mm and a thickness of 5 mm and furthermore, on it, a fluorine plastic tube with a thickness of 50 μm is coated.

Furthermore, in this embodiment, the pressing roller 27 is set so as to press the heat roller 26 with force of 170 N (Newton).

On the surface of the heat roller 26, a temperature sensor 29 for detecting the surface temperature of the heat roller 26 is installed. Further, to cope with a runaway of the heater lamp 28, a thermostat 30 is arranged on the heat roller 26, and when the heat roller 26 reaches an abnormal high temperature, it stops the heater lamp 28 from supplying power.

Further, the heater lamp 28 is connected to a power source 31. The heater lamp 28 is supplied with a voltage from the power source 31, thereby the temperature thereof rises. The power source 31 and temperature sensor 29 are connected via a heat roller controller 32 which is a controller.

Figure 8:
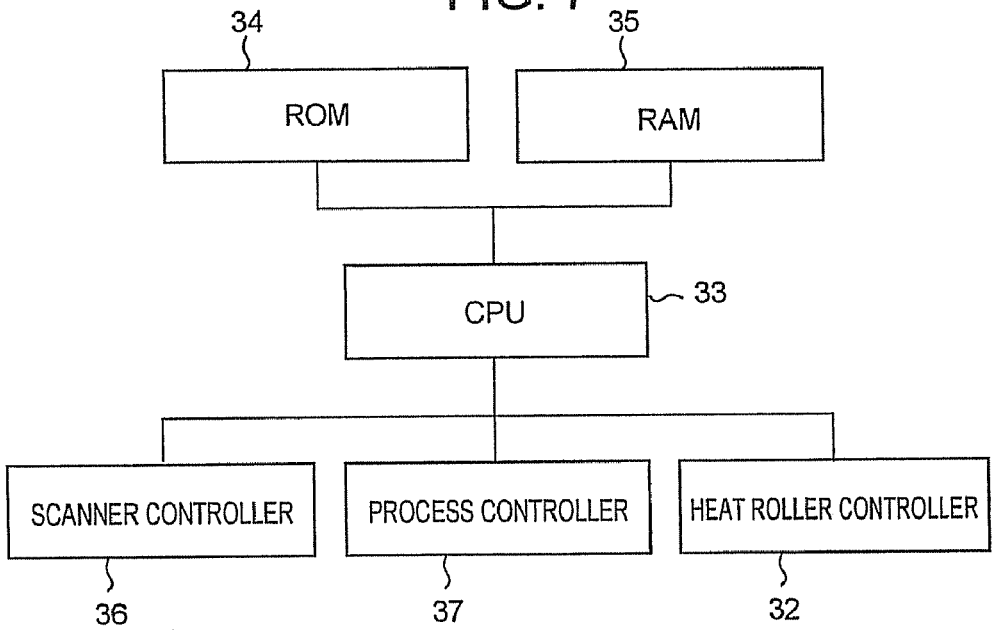
FIG. 8 is a block diagram showing the schematic constitution of the control system of the main body.

FIG. 8 shows a schematic constitution of the control system of the main body 1. Namely, the main body 1 is composed of a CPU 33 for managing controlling of the whole apparatus, a ROM 34 storing a control program, a RAM 35 for storing data, a scanner controller 36 for controlling the scanner 19, a process controller 37 for controlling each device composing the process cartridge 1A, and the heat roller controller 32 for controlling turning on or off the heater lamp 28 of the fixing device 8.

Figure 4:
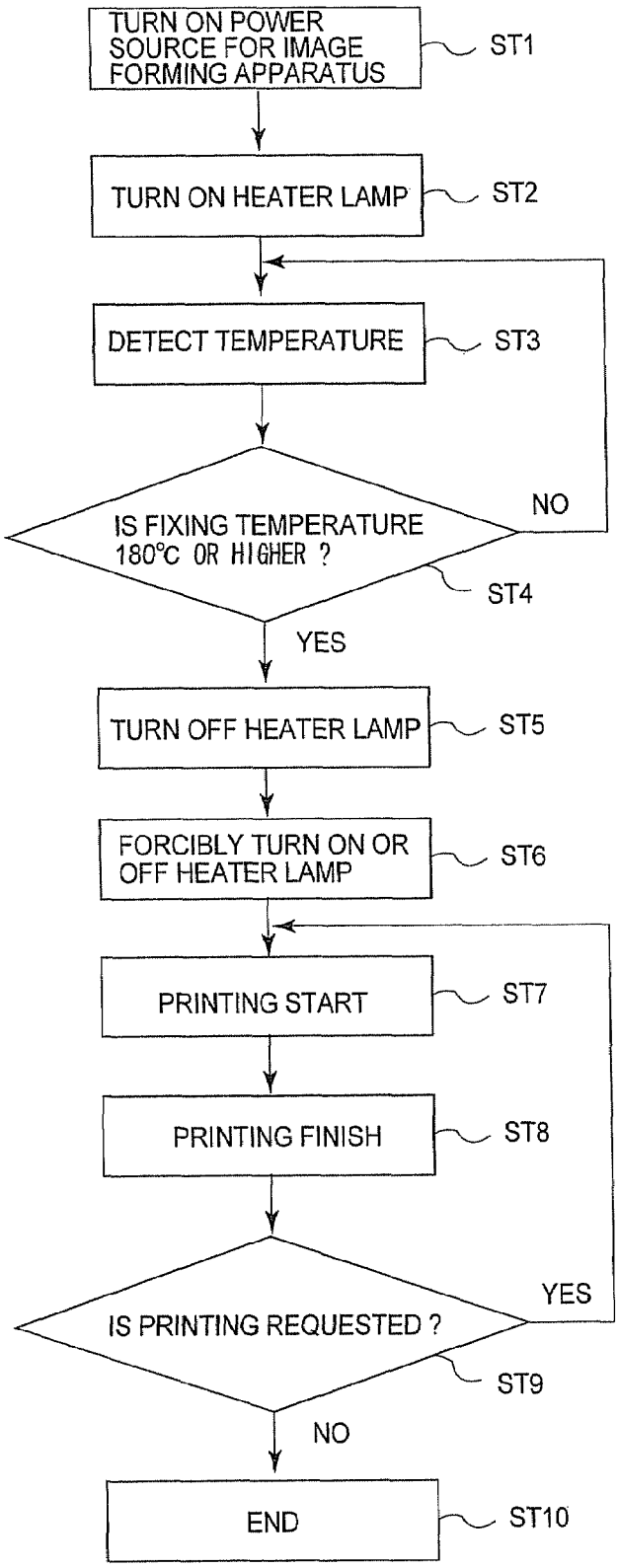
FIG. 4 is a flow chart showing the operation of temperature control of this embodiment.

Next, the temperature control of this embodiment will be explained by referring to FIG. 4. The control for printing by the image forming apparatus from the off state will be explained.

When the power source of the image forming apparatus is turned on (ST1), the heater lamp 28 is turned on by the heat roller controller 32 (ST2) and the heat roller 26 raises the temperature. Thereafter, the surface temperature of the heat roller 26 is detected by the temperature sensor 29 (St3) and when the surface temperature of the heat roller 26 reaches the fixing temperature (for example, 180° C. in this embodiment) (YES at ST4), the heater lamp 28 is turned off (ST5).

Thereafter, the surface temperature of the heater lamp 29 rises higher than the fixing temperature by overshooting. However, when the temperature begins to fall, to make the surface temperature of the heater lamp 29 fall stepwise, even if the surface temperature of the heat roller 26 is the fixing temperature or higher, the heater lamp 28 is forcibly turned on or off for a predetermined period of time (ST6).

When printing is requested next, a main motor, not drawn, of the image forming apparatus is driven and printing starts (ST7). After the printing is finished (ST8), whether there is another printing request or not is judged (ST9). When printing is requested additionally (YES at ST9), printing is performed and when printing is not requested (NO at ST9), the printing operation is finished.

Figure 5:
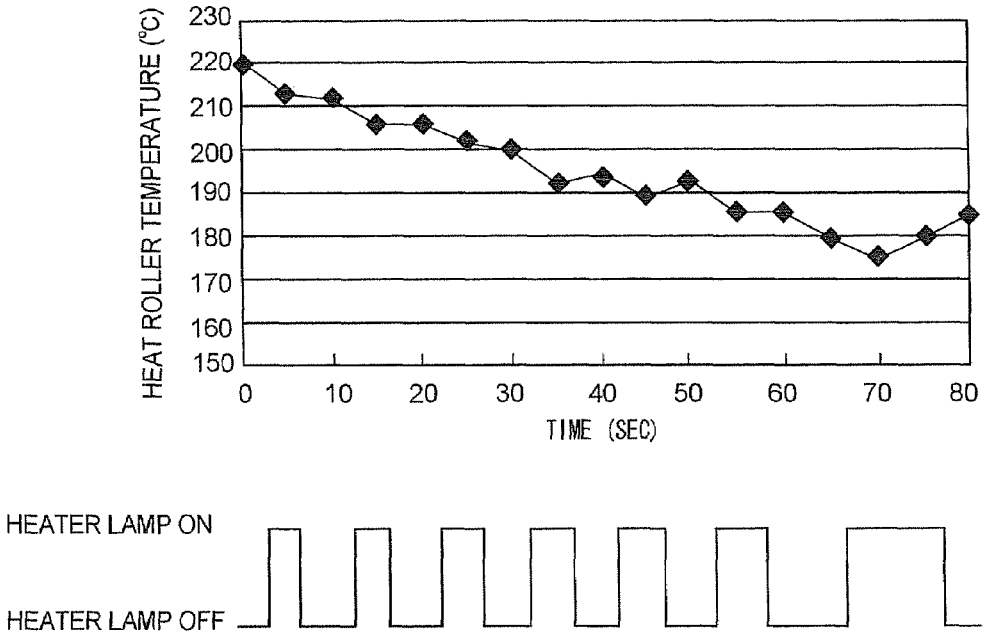
FIG. 5 is a graph and a timing chart showing the temperature change when the heater lamp is lit forcibly immediately after warming up.
Figure 6:
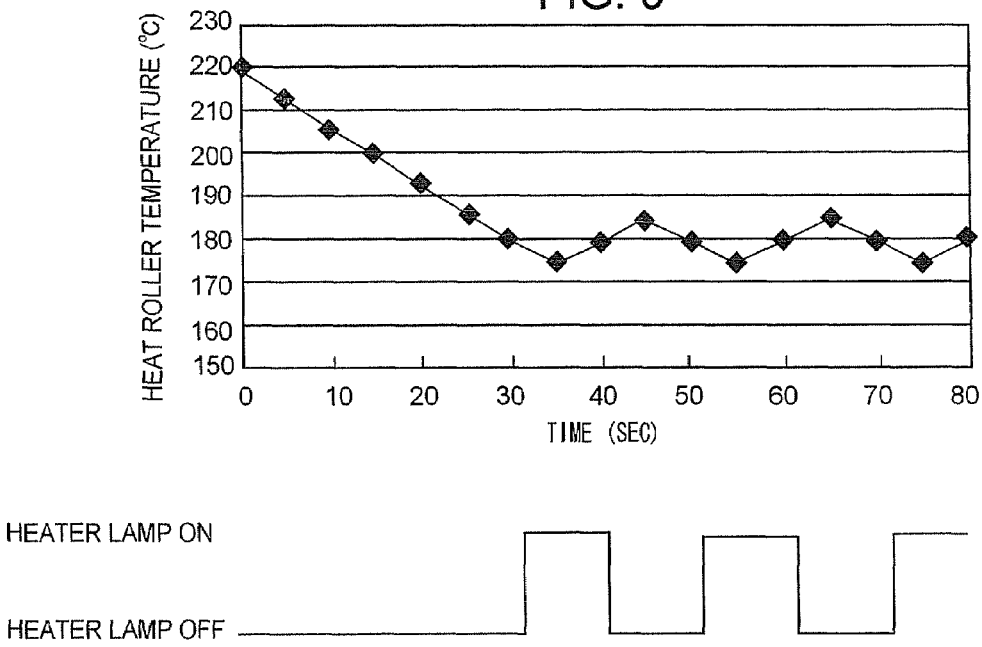
FIG. 6 is a graph and a timing chart showing the temperature change when the heater lamp is not lit forcibly immediately after warming up.
Figure 7:
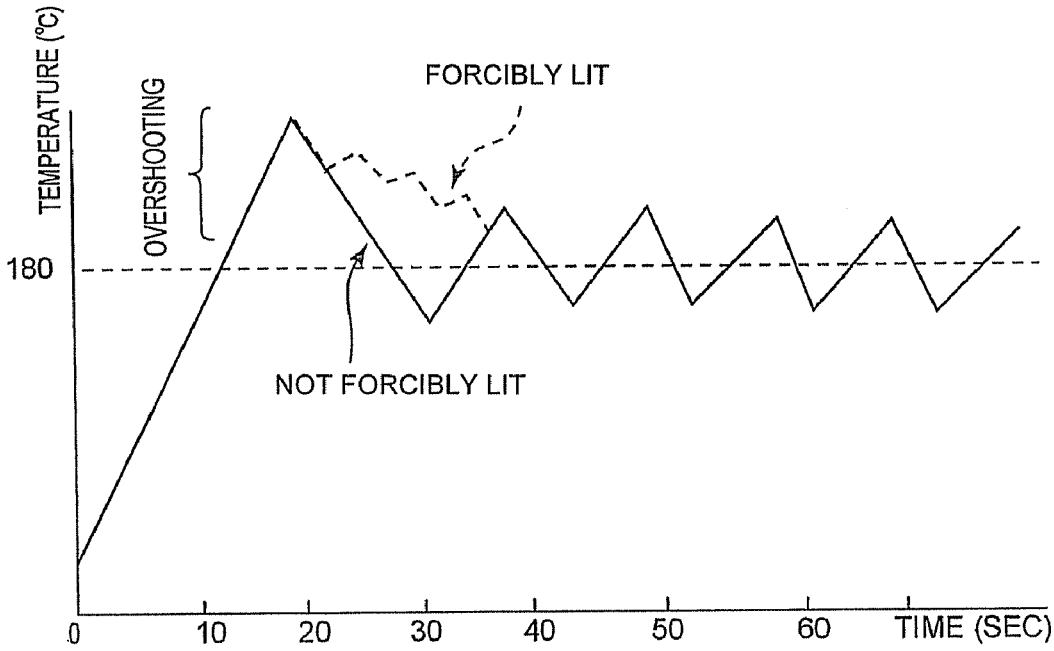
FIG. 7 is a graph showing the temperature change until the heat roller reaches from the room temperature state to the fixing temperature.

Here, the operation of forcibly turning on or off the heater lamp 28 at the fixing temperature or higher will be explained by referring to FIGS. 5 to 7. FIG. 5 shows a temperature change after the fixing device of this embodiment overshoots and the heat roller 26 reaches its maximum temperature. FIG. 6 shows a temperature change after a conventional fixing device overshoots and the heat roller 26 reaches its maximum temperature. FIG. 7 shows a temperature change while the heat roller 26 reaches from the room temperature state to the fixing temperature.

As shown in FIG. 7, when the heat roller 26 raises the temperature from the room temperature state and reaches the fixing temperature 180° C., it overshoots and raises the temperature up to 220° C. Hereafter, to make the temperature fall stepwise, the heater lamp 28 is repeatedly turned on or off for a predetermined period of time. By this operation, as shown in FIG. 5 and Table 1, the temperature of the heat roller 26 falls stepwise.

Here, in this embodiment, from the point of time when the heat roller overshoots and then the temperature falls, the heater lamp is forcibly turned on or off for a predetermined period of time, though even if the heater lamp is repeatedly turned on or off, to permit the temperature to hardly fall, the heater lamp is turned on or off.

TABLE 1

Control temperature: After overshooting, switching stepwise

| Time (s) | Control temperature (° C.) | Measured temperature (° C.) |
|---|---|---|
| 0 | 180 | 220 |
| 5 | 210 | 213.3 |
| 10 | 210 | 212 |
| 15 | 205 | 206 |
| 20 | 205 | 207 |
| 25 | 200 | 202 |
| 30 | 200 | 200 |
| 35 | 195 | 193 |
| 40 | 195 | 195 |
| 45 | 190 | 189 |
| 50 | 190 | 193 |
| 55 | 185 | 186 |
| 60 | 185 | 185 |
| 65 | 180 | 180 |
| 70 | 180 | 175 |
| 75 | 180 | 180 |
| 80 | 180 | 185 |

For comparison with this embodiment, after the heat roller 26 reaches the fixing temperature, the temperature changes when the heater lamp is not forcibly lit are shown in FIG. 6 and Table 2.

TABLE 2

Control temperature: 180° C. as unchanged

| Time (s) | Control temperature (° C.) | Measured temperature (° C.) |
|---|---|---|
| 0 | 180 | 220 |
| 5 | 180 | 213.3 |
| 10 | 180 | 206.6 |
| 15 | 180 | 199.9 |
| 20 | 180 | 193.2 |
| 25 | 180 | 186.5 |
| 30 | 180 | 180 |
| 35 | 180 | 175 |
| 40 | 180 | 180 |
| 45 | 180 | 185 |
| 50 | 180 | 180 |
| 55 | 180 | 175 |
| 60 | 180 | 180 |
| 65 | 180 | 185 |

TABLE 2-continued

Control temperature: 180° C. as unchanged

| Time (s) | Control temperature (° C.) | Measured temperature (° C.) |
|---|---|---|
| 70 | 180 | 180 |
| 75 | 180 | 175 |
| 80 | 180 | 180 |

As shown in FIG. 6 and Table 2, when the heat roller 26 is heated, the temperature of the heat roller 26 overshoots, so that it exceeds greatly the fixing temperature (180° C.) and rises up to 220° C. Thereafter, it falls lower than the fixing temperature after a lapse of 30 seconds. When the heater lamp 28 is not lit forcibly, the heater lamp 28 is turned off for a period of 30 seconds.

On the other hand, when forcibly lighting the heater lamp 28, until the temperature of the heat roller 26 falls lower than the fixing temperature after overshooting, the heater lamp 28 is forcibly turned on or off for a predetermined period of time. In this case, as shown in FIG. 5 and Table 1, the temperature of the heat roller 26 falls stepwise.

When forcibly turning on or off the heater lamp 28 like this, even if printing is requested, and the pressing roller 27 rotates, and the heat roller 26 is taken by the pressing roller 27, the temperature of the heat roller 26 is prevented from sudden reduction. Therefore, even if printing is requested while the temperature of the heat roller 26 falls down to the fixing temperature after overshooting, sufficient heat energy is stored in the heat roller 26 and pressing roller 27 and satisfactory fixing can be performed.

The fixing device of this embodiment, as shown in FIG. 3, is a fixing device of a roller type, though there is additionally a fixing device of a belt type and the present invention can be applied to either of them.

Further, as a heat source of the heat roller 26, the heater lamp is used, though an induction heating coil may be used.

According to the present invention, an image forming apparatus, a fixing device, and a fixing device control method, when the heat roller is heated from the room temperature state, overshoots above the fixing temperature, and then reduces in temperature, for forcibly driving the heat source in the heat roller, thereby preventing the heat roller from sudden reduction in temperature when printing is requested, and preventing defective fixing can be provided.

What is claimed is:

1. An image forming apparatus composing: an image forming unit to form a developer image on a medium; a heating body to heat the developer image formed on the medium; a heat source provided in the heating body to heat the heating body; a pressing body arranged opposite to the heating body to permit the medium to pass between the pressing body and the heating body, thereby pressurizing the developer image; and a controller to repeatedly turn on and off the heat source to make the temperature of the heating body fall stepwise to the fixing temperature after the temperature of the heating body rises to a maximum overshoot temperature.

2. The apparatus according to claim 1, wherein the controller sets a control temperature, after the temperature of the heating body rises higher than the fixing temperature, for sequentially reducing a higher temperature than the fixing temperature and on the basis of the control temperature, turns on or off the heat source so as to fall stepwise a measured temperature down to the fixing temperature.

3. The apparatus according to claim 1, wherein the heat source includes a heater lamp.

4. The apparatus according to claim 1, wherein the heat source includes an induction heating coil.

5. The apparatus according to claim 1, wherein the heating body includes a hollow metal roller coated with fluorine resin on its peripheral surface.

6. The apparatus according to claim 1, wherein the heating body includes a thin hollow metal roller having a low heat capacity.

7. The apparatus according to claim 1, wherein the pressing body is structured so as to coat rubber on a metal core bar and furthermore coat a fluorine resin tube on the rubber coat.

8. A fixing device composing: a heating body to heat a developer image formed on a medium; a heat source provided in the heating body to heat the heating body; a pressing body arranged opposite to the heating body to permit the medium to pass between the pressing body and the heating body, thereby pressurizing the developer image; and a controller to repeatedly turn on and off the heat source to make the temperature of the heating body fall stepwise to the fixing temperature after the temperature of the heating body rises to a maximum overshoot temperature.

9. The device according to claim 8, wherein the controller sets a control temperature, after the temperature of the heating body rises higher than the fixing temperature, for sequentially reducing a higher temperature than the fixing temperature and on the basis of the control temperature, turns on or off the heat source so as to fall stepwise a measured temperature down to the fixing temperature.

10. The device according to claim 8, wherein the heat source includes a heater lamp.

11. The device according to claim 8, wherein the heat source includes an induction heating coil.

12. The device according to claim 8, wherein the heating body includes a hollow metal roller coated with fluorine resin on its peripheral surface.

13. The device according to claim 8, wherein the heating body includes a thin hollow metal roller having a low heat capacity.

14. The device according to claim 8, wherein the pressing body is structured so as to coat rubber on a metal core bar and furthermore coat a fluorine resin tube on the rubber coat.

15. A fixing temperature control method for a fixing device comprising a heating body and a pressing body arranged opposite to the heating body, comprising: heating the heating body by a heat source from a room temperature state; and repeatedly turning on or off the heat source to make the temperature of the heating body fall stepwise to the fixing temperature after the temperature of the heating body rises to a maximum overshoot temperature.

16. The method according to claim 15, wherein after the temperature of the heating body rises higher than the fixing temperature, a control temperature for sequentially reducing a higher temperature than the fixing temperature is set and on the basis of the control temperature, the heat source is turned on or off so as to fall stepwise a measured temperature down to the fixing temperature.

17. The method according to claim 15, wherein the heat source includes a heater lamp.

18. The method according to claim 15, wherein the heat source includes an induction heating coil.

19. The method according to claim 15, wherein the heating body includes a hollow metal roller coated with fluorine resin on its peripheral surface.

20. The method according to claim 15, wherein the heating body includes a thin hollow metal roller having a low heat capacity.

21. The method according to claim 15, wherein the pressing body is structured so as to coat rubber on a metal core bar and furthermore coat a fluorine resin tube on the rubber coat.

* * * * *